US006079397A

United States Patent [19]

Matsumoto et al.

[11] Patent Number: 6,079,397

[45] Date of Patent: Jun. 27, 2000

[54] APPARATUS AND METHOD FOR ESTIMATING CONCENTRATION OF VAPORIZED FUEL PURGED INTO INTAKE AIR PASSAGE OF INTERNAL COMBUSTION ENGINE

[75] Inventors: Mikio Matsumoto; Masaya Furushou; Shigeaki Kakizaki; Hiraku Ooba, all of Yokohama, Japan

[73] Assignee: Nissan Motor Co., Ltd., Yokohama, Japan

[21] Appl. No.: 09/130,485

[22] Filed: Aug. 7, 1998

[30] Foreign Application Priority Data

Aug. 8, 1997 [JP] Japan ..... 9-214379

[51] Int. Cl.[7] ..... F02B 75/08

[52] U.S. Cl. ..... 123/698; 123/295

[58] Field of Search ..... 123/698, 295, 123/305, 520

[56] References Cited

U.S. PATENT DOCUMENTS 5,524,600 6/1996 Wild ..... 123/698
5,626,122 5/1997 Azuma ..... 123/698
5,655,507 8/1997 Kawasaki ..... 123/698
5,699,778 12/1997 Muraguchi et al. ..... 123/520
5,839,421 11/1998 Suzuki ..... 123/698
5,944,003 8/1999 Osanai ..... 123/520

*Primary Examiner*—John Kwon
*Attorney, Agent, or Firm*—Foley & Lardner

[57] ABSTRACT

In a, so-called, lean burn engine having a vaporized fuel processor, a concentration of a vaporized fuel purged into an intake air passage (so-called, a purge concentration) is estimated using a normal type oxygen concentration sensor. Whenever a predetermined interval of time has passed, the engine combustion condition is forcefully and temporarily transferred into a stoichiometric air-fuel mixture ratio combustion condition during which the purge concentration is estimated on the basis of an output signal from the oxygen concentration sensor during an air-fuel mixture ratio feedback control.

15 Claims, 6 Drawing Sheets

APPARATUS AND METHOD FOR ESTIMATING CONCENTRATION OF VAPORIZED FUEL PURGED INTO INTAKE AIR PASSAGE OF INTERNAL COMBUSTION ENGINE

The contents of the Application No. Heisei 9-214379, with a filing date of Aug. 8, 1997 in Japan, is herein incorporated by reference.

BACKGROUND OF THE INVENTION a) Field of the Invention

The present invention relates to a technique for estimating a concentration of a vaporized fuel purged into an intake air system of an internal combustion engine in which a vaporized fuel processor is installed and a combustion condition is transferred between a lean air-fuel mixture ratio combustion and a stoichiometric air-fuel mixture ratio combustion.

b) Description of the Related Art

A Japanese Patent Application First Publication No. Heisei 7-42588 published on Feb. 10, 1995 exemplifies a previously proposed vaporized fuel processor for an internal combustion engine which is constituted by a canistor for adsorbing a vaporized fuel onto an activated carbon thereof and a purge control valve interposed in a purge passage of the vaporized fuel linked from the canistor to an intake air system of the engine for controlling a purge quantity of the vaporized fuel.

It is necessary to correct a fuel supply (injection) quantity according to the concentration of the vaporized fuel in the internal combustion engine having the vaporized fuel processor according to the concentration of the vaporized fuel.

An oxygen concentration sensor is installed in an exhaust gas passage of the engine for detecting a rich or lean exhaust gas air-fuel mixture ratio.

In the engine in which the air-fuel mixture ratio is feedback controlled so that the air-fuel mixture ratio approaches to the stoichiometric air-fuel mixture ratio, the above-described correction can be achieved by the air-fuel mixture ratio feedback control.

SUMMARY OF THE INVENTION

However, since, the internal combustion engine (so-called, a lean burn engine) in which a combustion condition is transferred into a lean air-fuel mixture ratio combustion at least under a predetermined engine driving condition, a normal type oxygen concentration sensor is used which detects a rich and lean state of the exhaust gas air-fuel mixture ratio, the feedback control to a target lean air-fuel mixture ratio cannot be made.

Although such a wide range type oxygen concentration sensor that directly detects the exhaust gas air-fuel mixture ratio can be utilized, this type of oxygen concentration sensor is expensive and the manufacturing cost of the engine is increased.

Hence, an automotive industry demands that, even in the lean burn engine, the concentration of the vaporized fuel in the intake air system be estimated using the normal type oxygen concentration sensor so that the correction of the fuel injection quantity and other various kinds of engine operation controls can be achieved.

It is therefore an object of the present invention to provide apparatus and method for estimating a concentration of a vaporized fuel for an internal combustion engine in which a combustion condition can be transferred into a lean air-fuel mixture ratio combustion (so-called, a lean burn engine) which can accurately determine a concentration of the vaporized fuel in an intake air (viz., an intake air passage of the engine) to the engine using a normal-type oxygen concentration ($O_2$) sensor.

According to one aspect of the present invention, an internal combustion engine is provided. The internal combustion engine comprises: a) an intake air passage; b) a fuel tank; c) a vaporized fuel control device, interposed between the fuel tank and the intake air passage, for adsorbing a vaporized fuel from the fuel tank and for purging the vaporized fuel therefrom into the intake air passage; d) an oxygen concentration sensor, installed in an exhaust gas passage, for detecting an air-fuel mixture ratio according to a concentration of oxygen in an exhaust gas; e) a command generator for generating and outputting a command to the engine to forcefully transfer a combustion condition of the engine into a stoichimetric air-fuel mixture ratio combustion; and f) an estimator for estimating a concentration of the vaporized fuel purged into the intake air passage during the stoichiometric air-fuel mixture ratio combustion.

According to another aspect of the present invention, a method applicable to an internal combustion engine is provided. The method comprises the steps of: a) providing an intake air passage; b) providing a fuel tank; c) interposing a vaporized fuel processor between the fuel tank and the intake air passage; d) adsorbing a vaporized fuel from the fuel tank to the vaporized fuel processor; e) purging the vaporized fuel therefrom into the intake air passage; f) installing an oxygen concentration sensor in an exhaust gas passage; g) generating and outputting a command to the engine to forcefully transfer a combustion condition of the engine into a stoichiometric air-fuel mixture ratio combustion; h) detecting an air-fuel mixture ratio by the oxygen concentration sensor according to a concentration of oxygen in an exhaust gas; and i) estimating a concentration of the vaporized fuel purged into the intake air passage during the stoichiometric air-fuel mixture ratio combustion.

This summary of the invention does not necessarily describe all necessary features so that the invention may also be a sub-combination of these described features.

BEST MODE FOR CARRYING OUT THE INVENTION:

Reference will hereinafter be made to the drawings in order to facilitate a better understanding of the present invention.

Figure 1A:
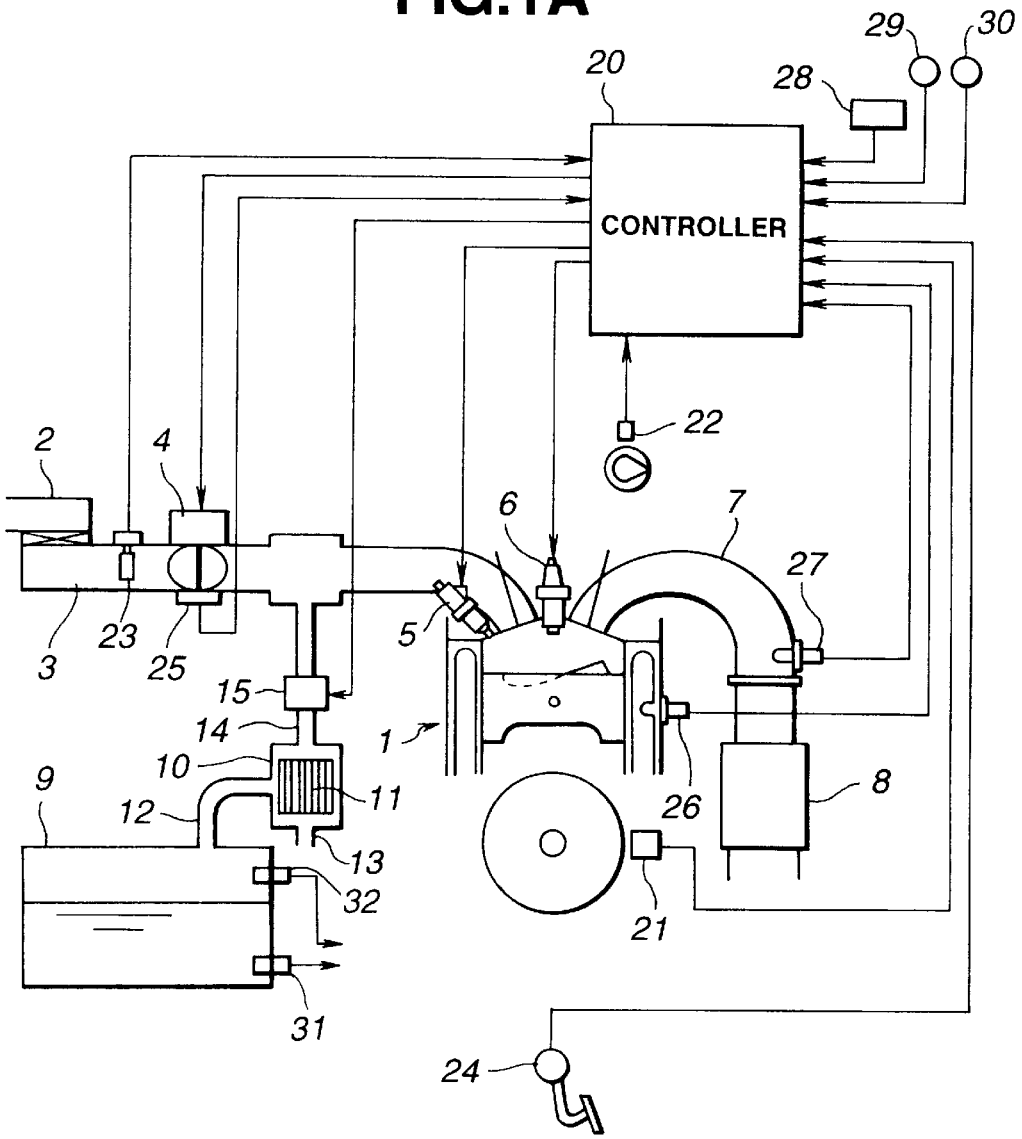
FIG. 1A shows a system configuration of an internal combustion engine to which the present invention in a first preferred embodiment of an apparatus for estimating a concentration of a vaporized fuel in an intake air is applicable.

FIG. 1A shows a system configuration of an internal combustion engine to which a first preferred embodiment of an apparatus for estimating a concentration of a vaporized fuel in an intake air according to the present invention is applicable.

Intake air from an air cleaner 2 is sucked into a combustion chamber of each cylinder of the engine 1 mounted in a vehicle through an intake air passage 3 receiving a control of its quantity from a throttle valve 4 (so-called, an electronically controlled throttle valve).

An electromagnetic type fuel injection valve (injector) 5 is installed in a part of the intake air passage 3 near to an intake valve so as to inject a given quantity of fuel (gasoline) into each corresponding combustion chamber.

Each fuel injection valve 5 has a solenoid portion thereof that opens in response to a fuel injection pulse signal outputted in a suction stroke or a compression stroke of its corresponding cylinder in synchronization with an engine rotation from a controller 20 so that the given quantity of fuel pressurized under a predetermined pressure is injected.

The injected fuel is diffused over each corresponding combustion chamber to form a homogeneous air mixture fuel in the case of the fuel injection at the suction stroke of each corresponding cylinder and is formed in a stratified air mixture fuel concentrated around a spark plug 6 in the case of the fuel injection at the compression stroke of each corresponding cylinder.

In response to an ignition signal from the controller 20, the spark plug 6 constituted by an ignition device is sparked to ignite and burn the air-fuel mixture in each combustion chamber so that the air-mixture fuel is combusted in a combustion condition as a, so-called, homogeneous charge combustion or stratified charge combustion.

It is noted that the combustion condition in the engine 1 is divided into three combustion conditions, in combination with an air-fuel mixture ratio control, a homogeneous stoichiometric air-fuel mixture ratio charge combustion; a homogeneous lean air-fuel mixture ratio combustion (air-fuel mixture ratio ranging from 20 to 30); and a stratified lean air-fuel mixture ratio combustion (air-fuel mixture ratio of approximately 40).

An exhaust gas from the engine 1 is exhausted through an exhaust gas passage 7 and a catalytic converter 8 used to purify the exhaust gas and being interposed within the exhaust gas passage 7.

A canistor 10 constituting a vaporized fuel processor is installed in the engine 1 so as to process the vaporized fuel generated by a fuel tank 9. The canistor 10 is filled with an adsorbent 11 such as an activated carbon within a sealed vessel, with a vaporized fuel introducing conduit 12 from the fuel tank 9 connected thereto.

Hence, the vaporized fuel developed in the fuel tank 9 during a stop of the engine 1 is introduced into the canistor 10 through the vaporized fuel introducing conduit 12 and is adsorbed onto the adsorbent 11 of the canistor 10.

The canistor 10 is formed with a fresh air introducing inlet 13 and a purge (gas) passage 14 extends from the canistor 10.

The purge passage 14 is connected to a downstream side (intake manifold) of the intake air passage 3 through a purge control valve 15. The purge control valve 15 is open in response to a signal outputted under a predetermined engine driving condition of the engine 1 from the controller 20. Hence, if a purge enabling combustion is established with the engine 1 being started, the purge control valve 15 is open so that an intake air negative pressure of the engine 1 is acted upon the canistor 10. Air introduced from the fresh air introducing inlet 13 causes the vaporized fuel adsorbed onto the adsorbent 11 of the canistor 10 to be desorbed from the adsorbent 11, the purge gas including the desorbed vaporized fuel being sucked into the downstream side of the intake air passage 3 with respect to the intake air passage 3 through the purge gas passage 14. Thereafter, the purge gas described above is combusted within each combustion chamber of the engine 1.

Figure 1B:
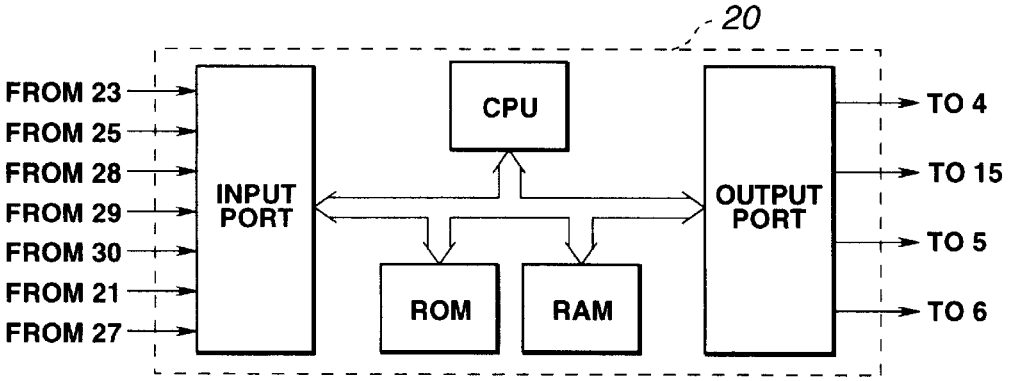
FIG. 1B shows a structure of a controller shown in FIG. 1A.

The controller 20 includes: a microcomputer having a CPU (Central Processing Unit), a ROM (Read Only Memory); RAM (Random Access Memory), a common bus, an Input Port having an A/D converter and an Output Port having an D/A converter, as shown in FIG. 1B.

Upon receipt of input signals from various engine driving condition sensors, the controller 20 performs various arithmetic/logic operations on the basis of the input signals and controls operations over each fuel injection valve 5, each spark plug 6, and the purge control valve 15.

The various types of the sensors include crank angle sensors 21 and 22 detecting a crankshaft axis rotation or camshaft axis rotation of the engine 1.

These crank angle sensors 21 and 22, if the engine 1 has the number of cylinders of n, outputs to the controller 20 a reference pulse signal REF at a predetermined crank angular position (for example, 110° before upper top dead center in the compression stroke of each cylinder) whenever a crank angular position of 720°/n is inputted and outputs to the controller 20 a unit pulse signal POS whenever the crank angular position of 1° or 2° is revolved.

The CPU of the controller 20 can calculate an engine speed Ne from a period of the reference pulse signal REF.

The other sensors include: an air-flow meter 23 located at the upstream side of the intake air passage 3 with respect to the throttle valve 4 for detecting an intake air quantity Qa; an acceleration sensor 24 for detecting a depression angle through which a driver has depressed (accelerator depression angle)ACC; a throttle sensor 25 for detecting an opening angle TVO of the throttle valve 4 (including an idle switch which is turned to ON when the throttle valve 4 is completely closed); an engine coolant temperature sensor 26 for detecting a coolant temperature Tw of the engine 1; an (normal type) oxygen concentration sensor (so-called, $O_2$ sensor) 27 for outputting a signal corresponding to a rich and lean state of an exhaust gas air-fuel mixture ratio in the exhaust gas passage 7 (according to an oxygen concentration in the exhaust gas); and a vehicle speed sensor 28 for detecting a vehicle speed VSP.

Furthermore, if required, the various sensors include: an air conditioner operation gas pressure sensor 29 for detecting an operation gas pressure of the air conditioner, namely, a discharging pressure of an air compressor in the air conditioner; an external air temperature sensor 30 for detecting an external (ambient) air temperature Ta external to the vehicle; a fuel temperature sensor 31 for detecting a fuel temperature Tt within a fuel tank 9; and a pressure sensor 32 for detecting an air pressure Pt in the fuel tank 9.

Next, an explanation of estimation of a vaporized fuel concentration as a purge quantity according to the present invention will be described below.

The microcomputer of the controller 20 commands the engine 1 to temporarily carry out a stoichiometric air-fuel mixture ratio charge combustion (homogeneous stoichiometric air-fuel mixture ratio charge combustion).

The microcomputer of the engine 20, as shown in FIG. 1B, commands the engine 1 to be temporarily forced into a stoichiometric air-fuel mixture ratio combustion (homogeneous stoichiometric air-fuel mixture ratio combustion) whenever a predetermined interval of time has passed even during a lean air-fuel mixture ratio combustion condition (a homogeneous lean air-fuel mixture change combustion or a stratified lean air-fuel mixture ratio charge combustion).

During the above-described stoichiometric air-fuel mixture ratio combustion, a concentration of the vaporized fuel in the intake air is estimated on the basis of a signal derived from the oxygen concentration ($O_2$) sensor 27.

FIGS. 2, 3, 4, 5, 6, 7, 8, and 9 respectively show flowcharts executed by the controller 20.

Figure 2:
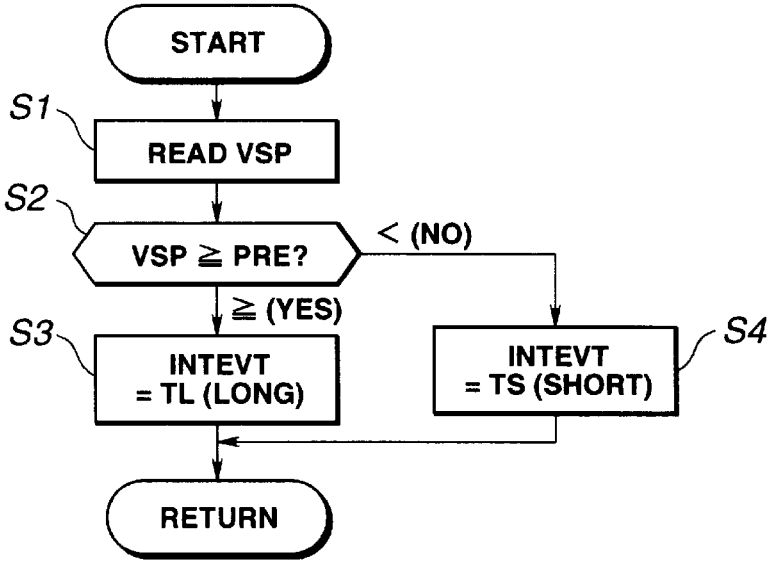
FIG. 2 shows a flowchart indicating an operation time interval variable routine in the first embodiment shown in FIGS. 1A and 1B.

FIG. 2 shows a routine to vary a time interval of operations which is executed in the first embodiment shown in FIG. 1A whenever a predetermined period of time has passed.

That is to say, at a step S1, the CPU of the controller 20 reads a vehicle speed VSP detected by the vehicle speed sensor 28.

At a step S2, the CPU of the controller 20 compares the vehicle speed VSP with a predetermined value (PRE) to determine whether the vehicle speed VSP is equal to or above the predetermined value.

If VSP≧PRE (Yes) at the step S2, viz., the vehicle speed is relatively high, the routine goes to a step S3.

If VSP<PRE (No) at the step S2, the routine goes to a step S3.

At the step S3, since a development velocity of the vaporized fuel is deemed to be slow, the CPU of the controller 20 assigns a value of TL into an operation interval INTEVT so that an operation interval INTEVT is set to a relatively long time TL (INTEVT =TL). The value of the relatively long time interval TL is, for example, 10 minutes.

As the vehicle speed VSP becomes high, wind developed along a vehicle body during a high speed run of the vehicle causes the fuel tank 9 to be cooled and a development speed of the vaporized fuel is decreased.

On the contrary, if VSP<PRE (relatively low vehicle speed), the CPU of the controller 20 can determine that the development speed of the vaporized fuel is high and the routine goes to a step S4.

At the step S4, the CPU of the controller 20 assigns a value of TS into the operation time interval INTEVT so that the operation time interval INTEVT is set to a relatively short time interval TS (INTEVT=TS). The value of the relatively short time interval TS is, for example, five minutes (300 seconds).

Figure 3:
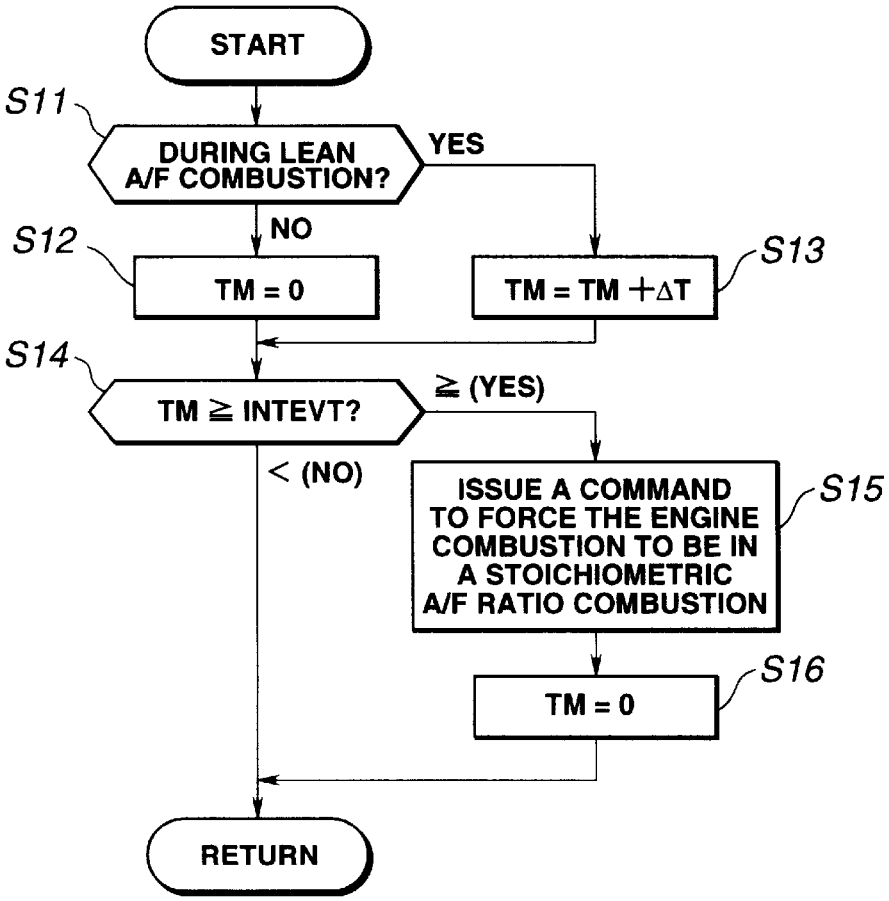
FIG. 3 shows a flowchart indicating a stoichiometric air-fuel mixture ratio force command determination routine in the first embodiment shown in FIGS. 1A and 1B.

FIG. 3 shows a stoichiometric air-fuel mixture ratio force command determination routine executed in the first embodiment shown in FIG. 1A whenever the predetermined period of time has passed.

At a step S11, the CPU of the controller 20 determines whether the present combustion condition falls in the lean combustion condition (homogeneous lean air-fuel mixture ratio charge combustion or stratified lean air-fuel mixture ratio charge combustion).

If the present combustion condition is not being in the lean combustion condition (the homogeneous stoichiometric air-fuel (A/F) mixture ratio charge combustion) (No) at the step S11, the routine goes to a step S12.

At the step S12, the CPU of the controller 20 resets a timer TM to zero (TM=0).

On the other hand, if the present combustion condition of the engine 1 is in the lean air-fuel mixture ratio (Yes) at the step S11, the routine goes to a step S13 in which the timer TM is incremented by an execution time interval (ΔT) of the routine of FIG. 3 (TM=TM+ΔT).

Consequently, the CPU of the controller 20 refers to the count value of the timer TM which indicates a continuation time of the lean air-fuel mixture ratio combustion.

At a step S14, the CPU of the controller 20 compares the timer TM with the operation interval INTEVT set by the routine of FIG. 3 to determine whether the value of the timer TM is equal to or larger than INTEVT (TM≧INTEVT).

If TM≧INTEVT (Yes) at the step S14, the routine goes to a step S15 in which the CPU of the controller 20 issues a command to force the combustion condition of the engine 1 into the stoichiometric air-fuel mixture ratio charge combustion.

At the step S16, the CPU of the controller 20 resets the timer TM to zero (TM=0).

Figure 4:
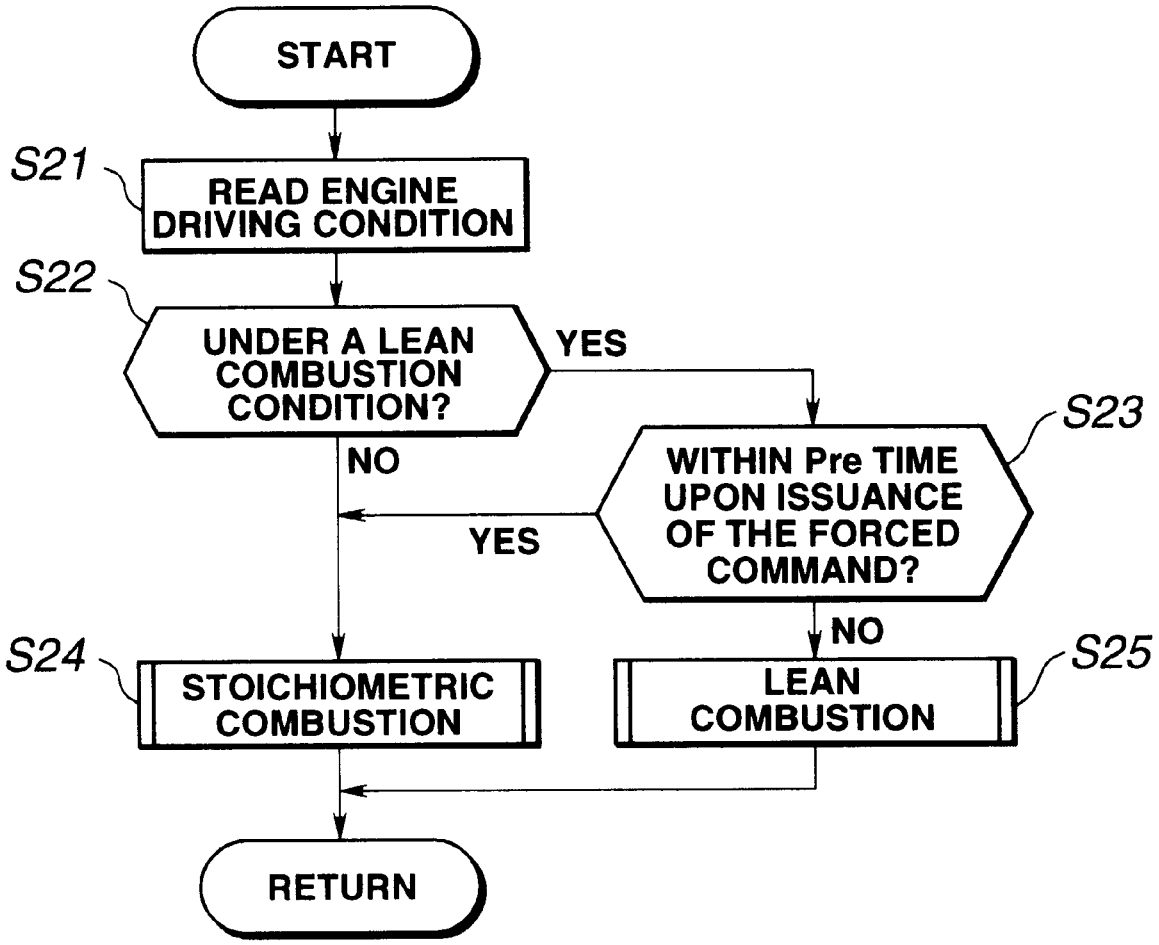
FIG. 4 shows a flowchart indicating a combustion condition control routine in the first embodiment shown in FIGS. 1A and 1B.

FIG. 4 shows a combustion condition control routine which is executed in the first embodiment shown in FIG. 1A whenever the predetermined period of time has passed.

At a step S22, the CPU of the controller 20 determines whether the present driving condition falls in a predetermined lean combustion condition in accordance with the driving condition of the engine 1.

In the case of the lean combustion condition (Yes) at the step S22, the routine goes to a step S23 that determines whether is within a predetermined time from a time at which the CPU of the controller 20 has issued the command to the engine 1 to be forced into the homogeneous stoichiometric air-fuel mixture ratio charge combustion.

If the present combustion condition is not under the lean air-fuel mixture combustion condition at the step S22 (NO) or it is within the predetermined time from the time at which the above-described command has been issued (YES) at the step S23, the routine goes to a step S24 in which the combustion condition of the engine 1 is in the homogeneous stoichiometric air-fuel mixture ratio combustion.

At the time of the homogeneous stoichiometric air-fuel mixture ratio charge combustion, at the step S25, the CPU of the controller 20 sets a target air-fuel mixture ratio of the air-fuel mixture so as to perform an air-fuel mixture ratio feedback control (closed loop control) and sets a fuel supply (injection) timing of a fuel at the suction stroke of each cylinder so that each cylinder performs the homogeneous stoichiometric air-fuel mixture ratio charge combustion.

On the other hand, at a step S25, the CPU of the controller 20 sets the target air-fuel mixture ratio to a lean air-fuel mixture ratio so as to perform an open loop control and the injection timing of the fuel is set to each suction stroke or to each compression stroke so as to perform the homogeneous lean air-fuel mixture ratio charge combustion or the stratified lean air-fuel mixture ratio charge combustion.

Figure 5:
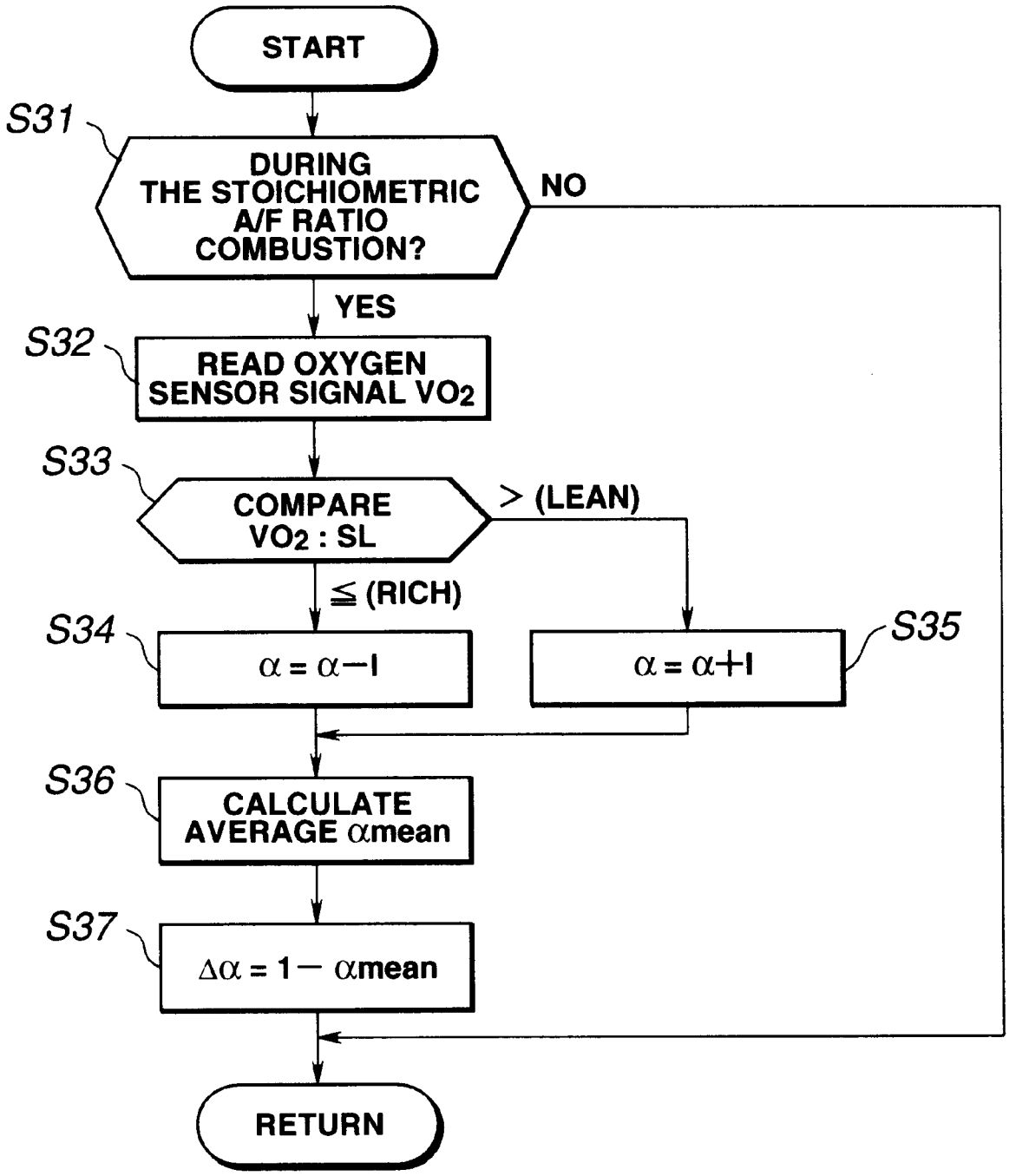
FIG. 5 shows a flowchart indicating a purge concentration estimation routine in the first embodiment shown in FIGS. 1A and 1B.

At a step S31 as shown in FIG. 5, the CPU of the controller 20 determines whether the present combustion condition is stoichiometric air-fuel mixture ratio combustion (during the feedback control of the air-fuel mixture ratio).

At a step S32, the CPU of the controller 20 reads an output signal (output voltage) $VO_2$ from the oxygen concentration ($O_2$) sensor 27.

At a step S33, the CPU of the controller compares a value of the output signal $VO_2$ with a predetermined slice level (SL) so as to determine a rich state or lean state of the exhaust gas air-fuel mixture ratio.

As a result of comparison, if $VO_2 \leqq SL$ (rich) at the step S33, the routine goes to a step S34 in which the air-fuel mixture ratio feedback correction coefficient a used to correct the fuel injection quantity is decreased by a predetermined integration component I ($\alpha=\alpha-I$).

On the contrary, if $VO_2>SL$ (lean), the routine goes to a step S35 in which the air-fuel mixture ratio feedback correction coefficient $\alpha$ is increased by the predetermined integration component I ($\alpha=\alpha+I$).

As described above, the CPU of the controller 20 multiplies a basic fuel supply (injection) quantity by the air-fuel mixture ratio feedback correction coefficient a increased or decreased by the integration control when the fuel supply (injection) quantity Ti is calculated.

Consequently, the air-fuel mixture ratio can be controlled so as to match with a target air-fuel mixture ratio, viz., a stoichiometric air-fuel mixture ratio.

It is noted that when the air-fuel mixture ratio feedback correction coefficient a is set, a proportional control is used together with the integration control to perform a proportional-integration control (P-I) over the air-fuel mixture ratio.

Next, at a step S36, the CPU of the controller 20 calculates an average value $\alpha$mean of the air-fuel mixture ratio feedback correction coefficient $\alpha$.

Specifically, whenever either an increment or decrement direction of the air-fuel mixture ratio feedback correction coefficient is inverted, the CPU of the controller 20 stores instantaneous air-fuel mixture ratio correction coefficient $\alpha$ at that time into a memory area such as the RAM and then calculates the average value $\alpha$ mean ($\alpha$max+$\alpha$min)/2 on the basis of the latest $\alpha$max ($\alpha$ when inverted from the increment direction to the decrement direction) and the latest amin (a when inverted from the decrement direction).

At a step S37, the CPU of the controller 20 calculates a deviation $\Delta\alpha$, namely, $\Delta\alpha=1-\alpha$mean of the average value $\alpha$mean of the feedback correction coefficient from a reference value of one as the purge concentration (quantity) estimation value.

It is noted that before the purge enabling condition is established, viz., the air-fuel mixture ratio feedback correction coefficient during no execution of the purge may be stored as $\alpha_0$ and, as the purge estimation value, the deviation of $\Delta\alpha$ ($\Delta\alpha=\alpha_0-\alpha$mean) may be calculated.

The magnitude of the purge concentration can be determined according to the thus calculated purge concentration corresponding value $\Delta\alpha$.

As described above, it is possible to correct the fuel supply (injection) quantity on the basis of the purge concentration after the combustion condition is transferred into the lean air-fuel mixture ratio combustion.

The corrected fuel supply (injection) quantity (Ti'lean) is calculated as follows:

Ti'lean=(Tilean)×($\alpha$o−$\alpha$mean), wherein Tilean=Ti×$\eta$, Tilean denotes a target fuel supply (injection) quantity during the lean combustion condition, $\eta$ denotes a fuel efficiency during the lean air-fuel mixture ratio combustion, and Tilean=Ti (a target fuel supply (injection) quantity) during the stoichiometric air-fuel mixture ratio combustion. In the above equation, the term of ($\alpha$0−$\alpha$mean ) may be replaced with (1−$\alpha$mean).

In addition, if the purge concentration is large, the return to the lean air-fuel mixture combustion may be delayed so as to continue the homogeneous stoichiometric air-fuel mixture ratio charge combustion for awhile. After the purge concentration becomes reduced to some degree, the present combustion may be transferred into the lean air-fuel mixture ratio combustion (corresponding to one of the stratified or homogeneous charge combustion).

Next, second, third, fourth, and fifth preferred embodiments of the apparatus for estimating the concentration of the vaporized fuel purged into the intake air system of the engine according to the present invention will be described with reference to FIGS. 6, 7, 8, and 9.

Figure 6:
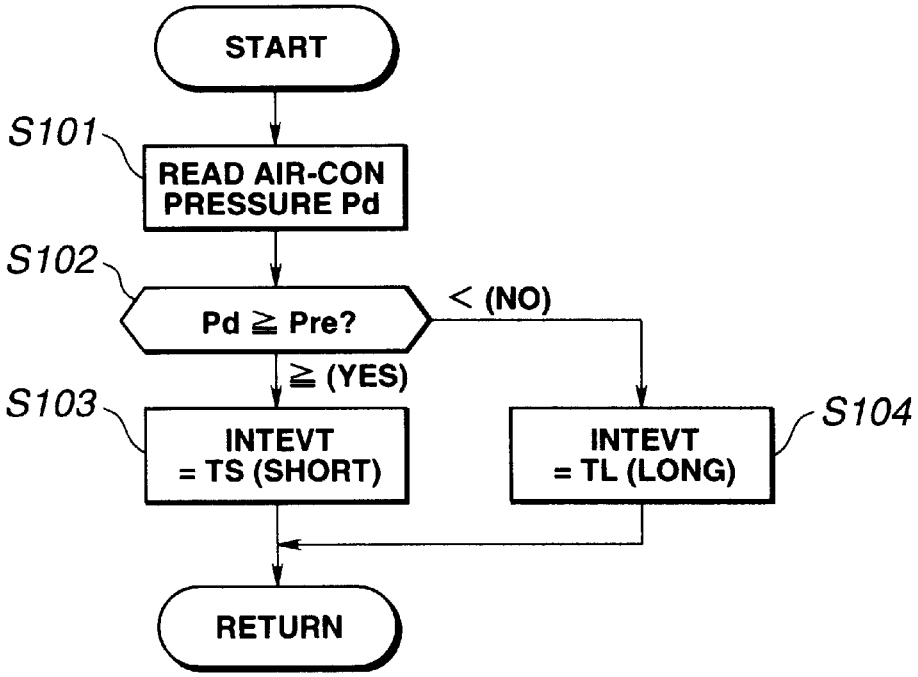
FIG. 6 shows a flowchart of the operation time interval in a second preferred embodiment of the apparatus for estimating the concentration of the vaporized fuel in the intake air according to the present invention.

FIG. 6 shows another operation time interval variable routine in place of the operation time interval variable routine shown in FIG. .2 as a second preferred embodiment according to the present invention.

At a step S101, the CPU of the controller 20 reads the air-conditioner operation gas pressure Pd detected by the air-conditioner operation gas pressure sensor 29.

At a step S102, the CPU of the controller 20 compares the air-conditioner operation gas pressure Pd with a predetermined value thereof Pre so as to determine whether the air-conditioner operation gas pressure Pd is equal to or above the predetermined value (Pre ).

If Pd≧Pre (the air-conditioner operation gas pressure Pd is so high as to be equal to or above the predetermined value) (Yes) at the step S102, the routine goes to a step S103 in which the CPU of the controller 20 assigns the relatively short time interval of TS into the operation time interval INTEVT so that the operation time interval INTEVT is set to the value of TS (INTEVT=TS).

As the air-conditioner operation gas pressure Pd becomes higher, the external air temperature can be deemed to be high and the development speed of the vaporized fuel is increased.

On the contrary, if Pd<Pre (low pressure) at the step S102 (NO), the routine goes to a step S104 in which the CPU of the controller 20 assigns the value of TL into the operation time interval (INTEVT) so that the operation time interval is set to the value of TL (INTEVT=TL).

As described above, the operation time interval INTEVT can be varied depending on an operation condition of the air conditioner (the air-conditioner operation gas Pd or the air conditioner power switch).

This can be achieved if the air-conditioner is mounted in the vehicle.

It is noted that the other structure and the routines are the same as those described in the first embodiment with reference to FIGS. 1A, 1B, 3, 4, and 5.

Figure 7:
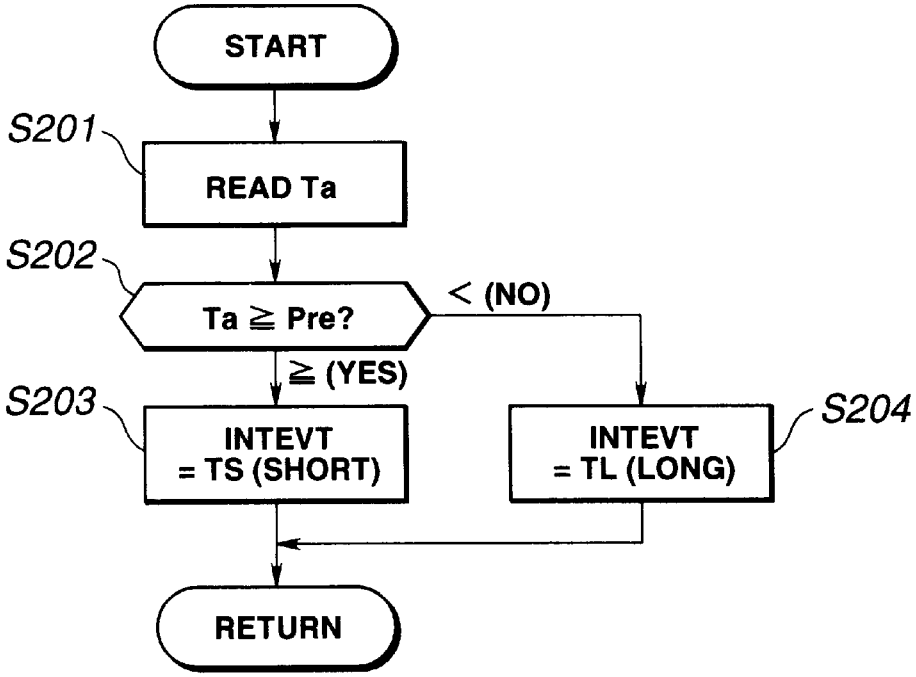
FIG. 7 shows a flowchart of the operation time interval in a third preferred embodiment of the apparatus for estimating the concentration of the vaporized fuel in the intake air according to the present invention.

FIG. 7 shows a still another operation time interval variable routine in place of the operation time interval routine shown in FIG. 2 as a third preferred embodiment according to the present invention.

At a step S201, the CPU of the controller 20 reads the external air temperature Ta detected by the external air temperature sensor 30.

At a step S202, the CPU of the controller 20 compares the external air temperature Ta with a predetermined value thereof (Pre) so as to determine whether the detected external air temperature Ta is equal to or above the predetermined value (Pre).

If Ta≧Pre (the external air temperature Ta is so high as to be equal to or above the predetermined value Pre) (Yes) at the step S203, the routine goes to a step S203 in which the CPU of the controller 20 assigns the relatively short time interval TS into the operation time interval INTEVT so that the operation time interval INTEVT is set to the value of TS (INTEVT=TS).

If Ta<Pre (relatively low temperature) at the step S302, the routine goes to a step S304 in which the CPU of the controller 20 assigns the relatively long time interval TL into the operation time interval INTEVT so that the time interval of INTEVT is set to the value of TL (INTEVT=TL).

As described above, since the external air temperature Ta has a high correlation to the development speed of the vaporized fuel, the concentration of the vaporized fuel can accurately be estimated.

It is noted that the other structure and the routines are the same as those described in the first embodiment shown in FIGS. 1A, 1B, 3, 4, and 5.

Figure 8:
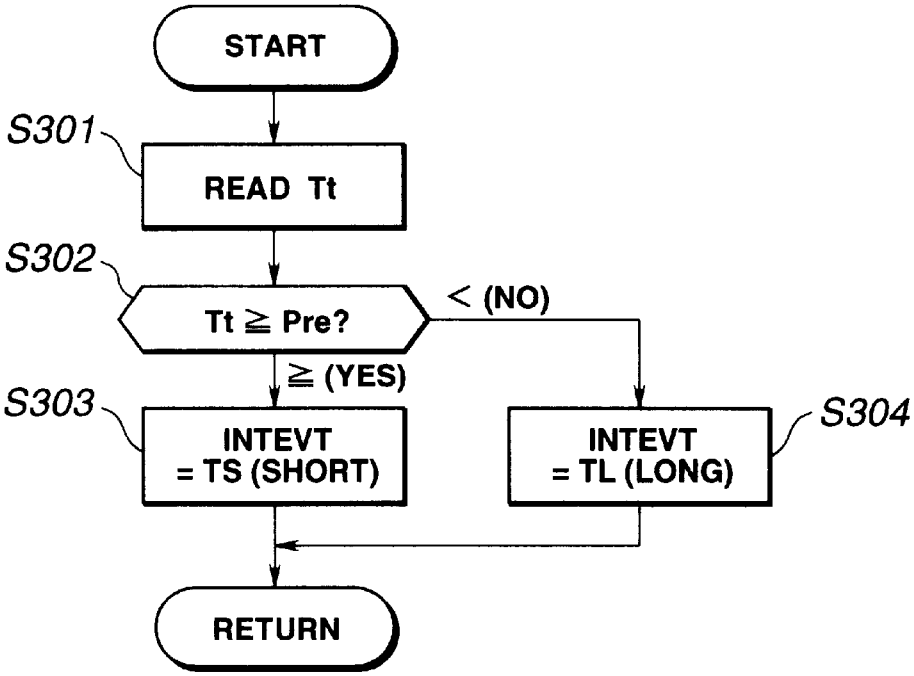
FIG. 8 shows a flowchart of the operation time interval in a fourth preferred embodiment of the apparatus for estimating the concentration of the vaporized fuel in the intake air according to the present invention.

FIG. 8 shows a still another operation time interval variable routine in place of the routine shown in FIG. 2 as a fourth preferred embodiment according to the present invention.

At a step S4, the CPU of the controller 20 reads an intake fuel temperature sensor Tt detected by the fuel temperature sensor 31 installed in the fuel tank 9.

At a step S402, the CPU of the controller 20 compares the in-tank fuel temperature Tt with a predetermined value thereof.

If Tt≧Pre (namely, the in-tank fuel temperature Tt is so high as to be equal to or above the predetermined value) (Yes) at the step S402, the CPU of the controller 20 determines that the development speed of the vaporized fuel is high and the routine goes to a step S403.

At the step S403, the CPU of the controller 20 assigns the relatively long time interval TS into the operation time interval INTEVT so that the operation time interval INTEVT is set to the value of TS (INTEVT=TS).

If Tt<Pre (namely, the in-tank fuel temperature Tt is so low as to be below the predetermined value) (No) at the step S402, the CPU of the controller 20 determines that the development speed of the vaporized fuel is so low and the routine goes to a step S304.

At the step S304, the CPU of the controller 20 assigns the relatively long time interval TL into the operation time interval INTEVT so as to be expressed as (INTEVT=TL).

As described above, since the in-tank fuel temperature Tt is a parameter that directly defines the development speed of the vaporized fuel, the concentration of the vaporized fuel based on the in-tank fuel temperature Tt can be estimated.

It is noted that the other structure and routines are the same as those described in the first embodiment shown in FIGS. 1A, 1B, 3, 4, and 5.

Figure 9:
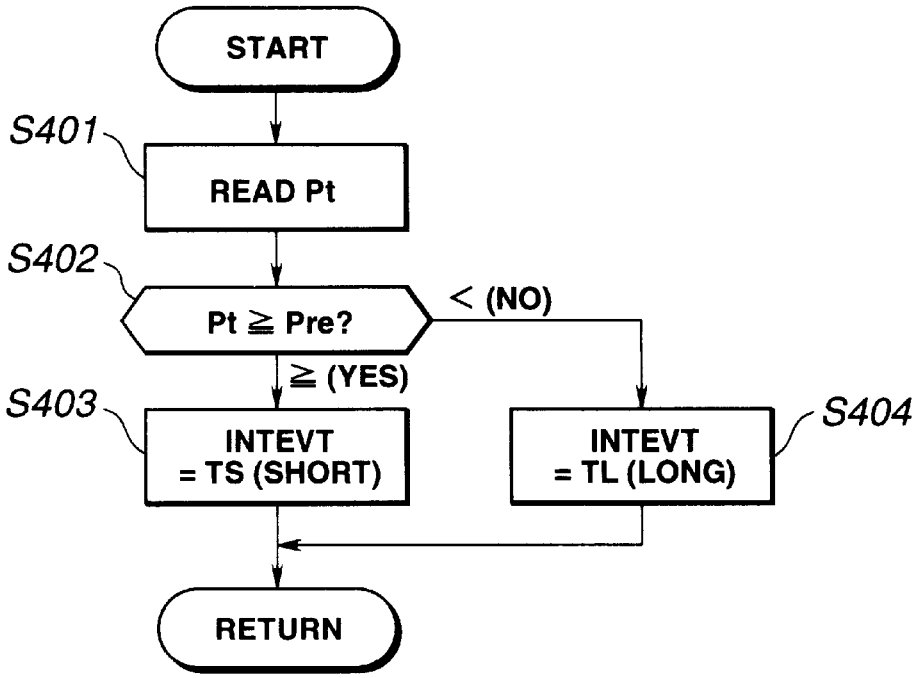
FIG. 9 shows a flowchart of the operation time interval in a fifth preferred embodiment of the apparatus for estimating the concentration of the vaporized fuel in the intake air according to the present invention.

FIG. 9 shows yet another operation time interval variable routine in place of the routine shown in FIG. 2 as a fifth preferred embodiment according to the present invention.

At a step S401, the CPU of the controller 20 reads the in-take air pressure Pt detected by the in-tank pressure sensor 32.

At a step S402, the CPU of the controller 20 compares the in-tank air pressure Pt with a predetermined value (Pre) so as to determine whether the intake air pressure Pt is equal to or above the predetermined value (Pre).

If Pt≧Pre (the in-tank pressure is so high as to be equal to or above the predetermined value (Yes) at the step S403, the CPU of the controller 20 determines that the development speed of the vaporized fuel is high and the routine goes to a step S403.

At the step S403, the CPU of the controller 20 assigns the relatively short time interval TS into the operation time interval INTEVT so that the operation time interval INTEVT is set to the relatively short time interval TS (INTEVT=TS).

If Pt<Pre (the in-tank pressure is so low as to be below the predetermined value) (No) at the step S404, the CPU of the controller 20 assigns the relatively long time interval TL into the operation time interval INTEVT so that the operation time interval INTEVT is set to the relatively long time interval TL (INTEVT=TL).

As described above, since the in-tank pressure Pt is a measurement result of the variation in the development speed of the vaporized fuel, the concentration of the vaporized fuel can be more accurately be estimated.

It is noted that the other structure and routines are the same as those described in the first embodiment shown in FIGS. 1A, 1B, 3, 4, and 5.

Although, in each of the preferred embodiments concerning FIGS. 1A through 9, the engine of the type in which the fuel is directly injected into each corresponding combustion chamber has been described, the present invention is applicable to all of the engines in which the combustion condition is divided into the lean air-fuel mixture ratio combustion and the stoichiometric air-fuel mixture ratio combustion.

It is also noted that each command generator, each estimator, each determinator, a fuel supply quantity corrector, and a air-fuel mixture ratio feedback controller described in the claims are incorporated in terms of software into the controller 20 as described above.

What is claimed is:

1. An internal combustion engine, comprising:

an intake air passage;

a fuel tank;

vaporized fuel control device, interposed between the fuel tank and the intake air passage, for adsorbing vaporized fuel from the fuel tank and for purging the vaporized fuel into the intake air passage;

an oxygen concentration sensor, provided in an exhaust gas passage, for detecting an air-fuel mixture ratio according to a concentration of oxygen in an exhaust gas;

a feed forward controller that provides feed forward control for the air-fuel mixture ratio in a lean combustion condition;

a feedback controller that provides feedback control for the air-fuel mixture ratio in a stoichiometric combustion condition;

a command generator for generating and outputting a command to transfer from the feed forward control to the feedback control;

a first estimator for estimating a concentration of the vaporized fuel purged into the intake air passage based on the air-fuel mixture ratio detected by the oxygen concentration sensor during the feedback control.

2. An internal combustion engine as claimed in claim 1, wherein the first estimator further comprises a second estimator for estimating a quantity of fuel vaporized in the fuel tank and the first estimator estimates the concentration of the vaporized fuel based on the estimate by the second estimator of the quantity of fuel vaporized in the fuel tank, and the command generator outputs the command to transfer to the feedback control after a predetermined interval of time has passed, the predetermined interval of time being varied on the basis of the estimation by the second estimator of the quantity of fuel vaporized in the fuel tank.

3. An internal combustion engine as claimed in claim 2, wherein the second estimator comprises a vehicle speed sensor for detecting a vehicle speed of a vehicle in which the engine is mounted and a first determinator for determining whether the detected vehicle speed is equal to or higher than a predetermined vehicle speed value, and wherein the predetermined interval of time is set to be relatively short when the first determinator determines that the vehicle speed is equal to or above the predetermined vehicle speed value.

4. An internal combustion engine as claimed in claim 2, wherein the second estimator comprises an air conditioner operation sensor for detecting whether an air conditioner of a vehicle in which the engine is mounted is operating, and the predetermined time interval is set to be relatively short when the air conditioner operation sensor detects that the air conditioner is operating.

5. An internal combustion engine as claimed in claim 2, wherein the second estimator comprises an external air temperature sensor for detecting an air temperature external to a vehicle in which the engine is mounted and a second determinator for determining whether the detected air temperature is equal to or above a predetermined air temperature value, and wherein the predetermined time interval is set to be relatively short when the second determinator determines that the detected air temperature is equal to or above the predetermined air temperature value.

6. An internal combustion as claimed in claim 2, wherein the second estimator comprises a fuel temperature sensor for detecting a temperature of the fuel in the fuel tank and a third determinator for determining whether the detected temperature of the fuel in the fuel tank is equal to or above a predetermined temperature value, and wherein the predetermined time interval is set to be relatively short when the third determinator determines that the detected temperature of the fuel in the fuel tank is equal to or above the predetermined temperature value.

7. An internal combustion engine as claimed in claim 2, wherein the second estimator comprises an air-pressure sensor for detecting air pressure in the fuel tank and a fourth determinator for determining whether the detected air pressure in the fuel tank is equal to or above a predetermined air pressure value, and wherein the predetermined time interval is set to be relatively short when the fourth determinator determines that the detected air pressure in the fuel tank is equal to or above the predetermined air pressure value.

8. An internal combustion engine as claimed in claim 1, wherein the first estimator estimates the concentration of the vaporized fuel purged into the intake air passage on the basis of an air-fuel mixture ratio feedback correction coefficient (a) in the stoichiometric combustion condition.

9. An internal combustion engine as claimed in claim 8, wherein the feedback controller performs feedback control over the air-fuel mixture ratio so as to make the air-fuel mixture ratio detected by the oxygen concentration sensor approach the stoichiometric air-fuel mixture ratio during the stoichiometric combustion condition, and wherein the first estimator estimates the concentration of the vaporized fuel purged into the intake air passage on the basis of an air-fuel mixture ratio feedback correction coefficient ($\alpha$) derived from an output signal of the oxygen concentration sensor by the feedback controller.

10. An internal combustion engine as claimed in claim 9, wherein the first estimator estimates the concentration of the vaporized fuel purged into the intake air passage from a deviation ($\Delta\alpha$) of an average value ($\alpha$mean), which is between a maximum value ($\alpha$max) and a minimum value ($\alpha$min) of the air-fuel mixture ratio feedback correction coefficient ($\alpha$), from a reference value.

11. An internal combustion engine as claimed in claim 9, wherein the first estimator estimates the concentration of the vaporized fuel purged into the intake air passage from a deviation ($\Delta\alpha$) of an average value ($\alpha$mean), which is between a maximum value ($\alpha$max) and a minimum value ($\alpha$min) of the air-fuel mixture ratio feedback correction coefficient ($\alpha$), from an air-fuel mixture ratio feedback correction coefficient ($\alpha_0$) during no purge of the vaporized fuel into the intake air passage.

12. An internal combustion engine as claimed in claim 1, which further comprises a lean combustion condition command generator for generating and outputting a command to transfer to the feed forward control during a predetermined engine driving condition, and a fuel supply quantity corrector for correcting a fuel supply quantity for the engine by a factor determined on the basis of the estimated quantity of the vaporized fuel purged into the intake air passage during the lean combustion condition.

13. A method applicable to an internal combustion engine comprising the steps of:

providing an intake air passage;

providing a fuel tank;

interposing a vaporized fuel processor between the fuel tank and the intake air passage;

adsorbing vaporized fuel from the fuel tank to the vaporized fuel processor;

purging the vaporized fuel from the vaporized fuel processor into the intake air passage;

providing an oxygen concentration sensor in an exhaust gas passage;

providing feed forward control of an air-fuel mixture ratio in a lean combustion condition;

providing feedback control of the air-fuel mixture ratio in a stoichiometric combustion condition;

generating and outputting a command from a command generator to transfer from the feed forward control to the feedback control;

detecting an air-fuel mixture ratio with the oxygen concentration sensor according to a concentration of oxygen in an exhaust gas; and estimating a concentration of the vaporized fuel purged into the intake air passage based on the air-fuel mixture ratio detected by the oxygen concentration sensor during the feedback control.

14. A method applicable to an internal combustion engine as claimed in claim 13, which further comprises the step of:

estimating a quantity of fuel vaporized in the fuel tank, wherein the concentration of the vaporized fuel purged into the intake air passage is estimated based on the estimated quantity of fuel vaporized in the fuel tank, and the command generator outputs the command to transfer to the feedback control whenever a predetermined interval of time has passed, the predetermined interval of time being varied on the basis of the estimated quantity of fuel vaporized in the fuel tank.

15. A method applicable to an internal combustion engine as claimed in claim 13, wherein[, at the estimating] step of i),] the concentration of the vaporized fuel purged into the intake air passage of the engine is estimated on the basis of the air-fuel mixture ratio detected by the oxygen concentration sensor.

* * * * *